US010490888B2

(12) United States Patent
Renilson et al.

(10) Patent No.: US 10,490,888 B2
(45) Date of Patent: Nov. 26, 2019

(54) RADOME-REFLECTOR ASSEMBLY MECHANISM

(71) Applicant: CommScope Technologies LLC, Hickory, NC (US)

(72) Inventors: Ian T. Renilson, Dalgety Bay (GB); John S. Curran, Kirkcaldy (GB); Douglas P. Hunter, Kirkcaldy (GB); David J. Walker, Glasgow (GB)

(73) Assignee: CommScope Technologies LLC, Hickory, NC (US)

( * ) Notice: Subject to any disclaimer, the term of this patent is extended or adjusted under 35 U.S.C. 154(b) by 218 days.

(21) Appl. No.: 15/412,244

(22) Filed: Jan. 23, 2017

(65) Prior Publication Data

US 2017/0133755 A1 May 11, 2017

Related U.S. Application Data

(62) Division of application No. 14/247,307, filed on Apr. 8, 2014, now Pat. No. 9,577,323.

(Continued)

(51) Int. Cl.
*H01Q 1/42* (2006.01)
*H01Q 15/16* (2006.01)

(Continued)

(52) U.S. Cl.
CPC ..... *H01Q 1/428* (2013.01); *H01Q 1/42* (2013.01); *H01Q 1/50* (2013.01); *H01Q 15/14* (2013.01); *H01Q 15/16* (2013.01); *H01R 4/28* (2013.01)

(58) Field of Classification Search
CPC ..... H01Q 1/428; H01Q 15/14; H01Q 15/16; F21V 17/10; F21V 17/12; F21V 17/14; F21V 17/16; F21V 17/18; F21V 17/20
See application file for complete search history.

(56) References Cited

U.S. PATENT DOCUMENTS 2,481,531 A * 9/1949 Phillips ..... F21V 17/00 220/324
3,351,947 A * 11/1967 Hart ..... H01Q 1/42 343/840

(Continued)

FOREIGN PATENT DOCUMENTS

| | | |
|---|---|---|
| EP | 2815688 | 7/2013 |
| EP | 2494651 | 12/2013 |
| FR | 2908393 | 5/2008 |

OTHER PUBLICATIONS

Notification Concerning Transmittal of Copy of International Preliminary Report on Patentability, International Application No. PCT/US2014/071074, dated Sep. 22, 2016, 10 pages.

(Continued)

*Primary Examiner* — Daniel Munoz
(74) *Attorney, Agent, or Firm* — Myers Bigel, P.A.

(57) ABSTRACT

In one embodiment, a radome-reflector assembly for, e.g., a microwave antenna, has (i) two semi-circular rims that receive the peripheries of the radome and the reflector and (ii) fixed and adjustable clamps that secure the ends of the rims together. The rims are designed with slanted inner surfaces that engage the periphery of the reflector, such that, when the adjustable clamp is tightened circumferentially, the periphery of the reflector is forced laterally to abut other rim structure to form a metal-to-metal RF seal between the reflector and the rims. Certain assemblies with low profiles and low circumferential forces can be assembled without special tooling using plastic clamps and still achieve good RF seals.

17 Claims, 9 Drawing Sheets

Related U.S. Application Data

(60) Provisional application No. 61/949,383, filed on Mar. 7, 2014.

(51) Int. Cl.

| | |
|---|---|
| ***H01Q 1/50*** | (2006.01) |
| ***H01Q 15/14*** | (2006.01) |
| ***H01R 4/28*** | (2006.01) |

(56) References Cited

U.S. PATENT DOCUMENTS

| | | | | |
|---|---|---|---|---|
| 7,042,407 | B2 | 5/2006 | Syed et al. | |
| 7,138,958 | B2 | 11/2006 | Syed et al. | |
| 8,077,113 | B2 | 12/2011 | Syed et al. | |
| 8,259,028 | B2 | 9/2012 | Hills et al. | |
| 8,405,570 | B2 | 3/2013 | Lewry et al. | |
| 8,558,746 | B2 | 10/2013 | Thomson et al. | |
| 8,581,795 | B2 | 11/2013 | Simms et al. | |
| 2005/0190116 | A1* | 9/2005 | Syed | H01Q 19/19 343/872 |
| 2009/0295677 | A1 | 12/2009 | Gratton et al. | |
| 2010/0328190 | A1* | 12/2010 | Proffitt | H01Q 15/162 343/915 |
| 2013/0082896 | A1 | 4/2013 | Renilson et al. | |
| 2013/0099991 | A1 | 4/2013 | Wright et al. | |

OTHER PUBLICATIONS

International Search Report and Written Opinion, dated Mar. 25, 2015, for the corresponding PCT Application No. PCT/US2014/071074.

Examination Report corresponding to European Application No. 14825045.9 dated Jun. 6, 2019.

* cited by examiner

RADOME-REFLECTOR ASSEMBLY MECHANISM

CROSS-REFERENCE TO RELATED APPLICATIONS

The present application claims priority under 35 U.S.C. § 120 as a divisional of U.S. patent application Ser. No. 14/247,307, filed Apr. 8, 2014 which application claims the benefit of the filing date of U.S. provisional application No. 61/949,383, filed on Mar. 7, 2014, the teachings of which are incorporated herein by reference in their entirety.

BACKGROUND

1. Field of the Invention

The present invention relates to antennas, such as microwave reflector antennas, and, more specifically but not exclusively, to mechanisms for retaining a radome upon the periphery of the reflector dish of such antennas.

2. Description of the Related Art

This section introduces aspects that may help facilitate a better understanding of the invention. Accordingly, the statements of this section are to be read in this light and are not to be understood as admissions about what is prior art or what is not prior art.

U.S. patent application publication no. 2013/0099991 A1 ("the '991 publication"), the teachings of which are incorporated herein by reference, discloses a rim-based mechanism for retaining a radome upon the periphery of the reflector dish of a microwave reflector antenna. For typical applications, a relatively large clamping fixture is used to apply enough force to hold two semi-circular, metallic rims securely in place over the periphery of the mated radome and reflector dish while the rims are fastened to provide an RF seal with the reflector dish that limits RF leakage during antenna transmission. To reduce RF leakage to satisfactory levels, this rim-based mechanism often requires a backlobe suppression ring, which is frequency specific. See, e.g., U.S. Pat. No. 7,138,958, the teachings of which are incorporated herein by reference. In addition, the use of the large clamping fixture limits the act of assembling the various elements into the desired radome-reflector assembly to be implemented in only those locations where such a fixture is available.

BRIEF DESCRIPTION OF THE DRAWINGS

Other embodiments of the invention will become more fully apparent from the following detailed description, the appended claims, and the accompanying drawings in which like reference numerals identify similar or identical elements.

DETAILED DESCRIPTION

Figure 1B:
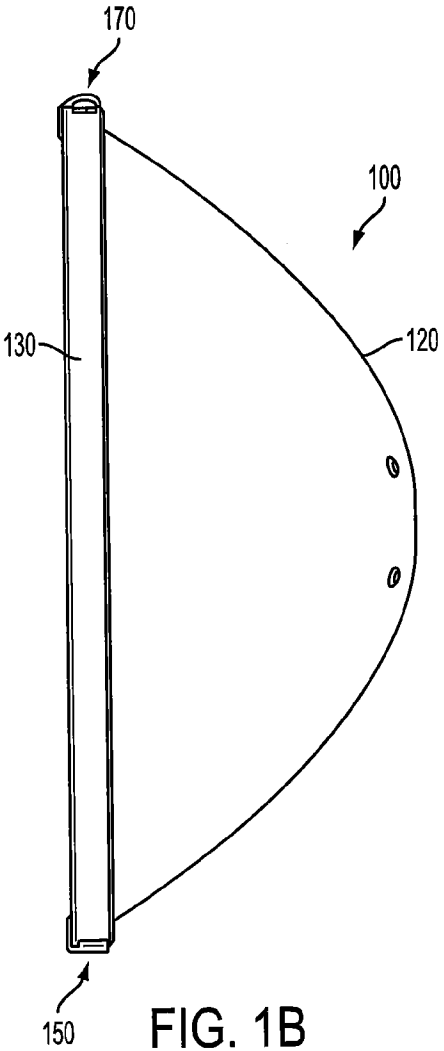
FIGS. 1(A)-(B) show an exemplary radome-reflector assembly of the disclosure.
Figure 1A:
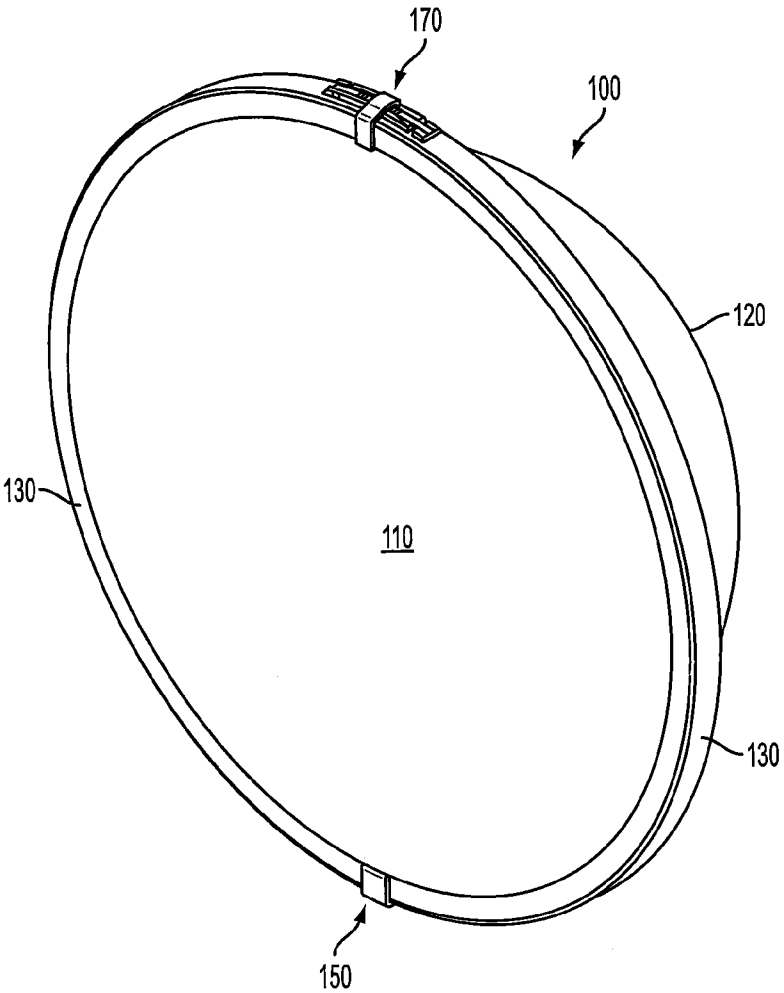

FIGS. 1(A) and 1(B) respectively show perspective and side views of an exemplary radome-reflector assembly 100 for an antenna such as a microwave reflector antenna according to the disclosure. Assembly 100 comprises a radome 110 mated to the open end of a metal reflector dish (also referred to herein simply as reflector) 120 by a rim-based mechanism comprising two semi-circular metal rims 130, a fixed clamp 150, and an adjustable clamp 170.

As described more fully below, the assembly 100 can be assembled by placing the two rims 130 around opposing sides of the peripheries of the radome 110 and the reflector 120. Two of the ends of the two rims are then secured together using the fixed clamp 150, then the other two ends of the two rims are loosely connected using the adjustable clamp 170 (i.e., with the adjustable clamp 170 at or near the loosest setting of its adjustment range). The adjustable clamp 170 is then adjusted towards its tightest setting until a desired seal is established between the radome and the reflector. In some embodiments, the multi-piece adjustable clamp 170 is pre-assembled at its relatively loose setting prior to its attachment to the rims.

If the adjustment range of the adjustable clamp 170 is great enough, a slightly different procedure can be employed to assemble the assembly 100. According to this different procedure, the two rims 130 are initially placed around the opposing sides of the periphery of only the radome 110, and the fixed clamp 150 and the (pre-assembled) adjustable clamp 170 are then applied to loosely secure the radome within the rims. This sub-assembly is then fitted over the periphery of the reflector 120, and the adjustable clamp 170 is then tightened to complete the assembly procedure.

Figure 2:
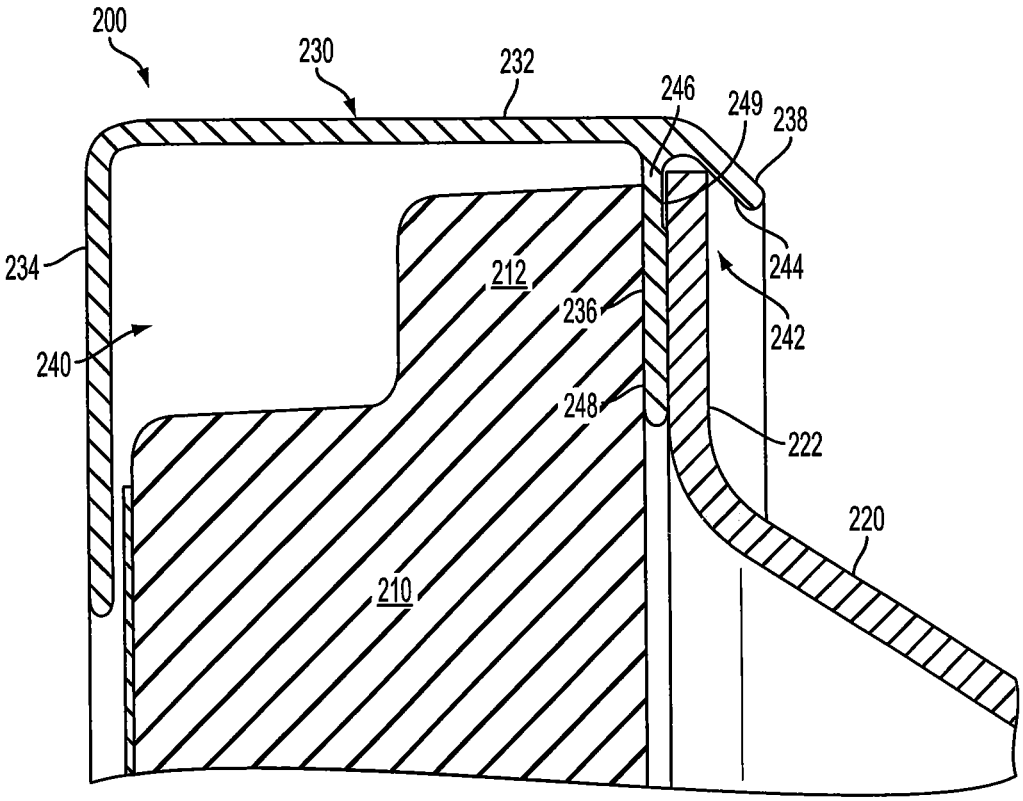
FIG. 2 shows a portion of another exemplary radome-reflector assembly of the disclosure.

FIG. 2 shows a cross-sectional side view of a portion of another exemplary radome-reflector assembly 200 of the disclosure. FIG. 2 shows a rim 230 retaining the periphery of radome 210 onto the periphery 222 of reflector 220. Rim 230 has the following features or elements:

A semi-cylindrical, circumferential rim body 232, supporting the other elements of the rim;

A first, radial rim leg 234, extending perpendicularly from the rim body 232 towards the center line of the semi-cylinder defined by the rim body;

A second, radial rim leg 236, shorter than the first rim leg 234, but also extending perpendicularly from the rim body 232 towards the semi-cylinder center line; and A third rim leg 238, shorter than the second rim leg 236 and extending from the rim body 232 at about a 45-degree angle towards the semi-cylinder center line. Note that, with reference to FIG. 1, the analogous semi-cylinder center line referred to above intersects the center point of radome 110 and the center point of the back end of reflector 120. Although, in the embodiment of FIG. 2, the second rim leg 236 is shorter than the first rim leg 234, in alternative embodiments, the second rim leg may be the same size or even longer than the first rim leg. Furthermore, although, in the embodiment of FIG. 2, the third rim leg 238 extends from the rim body 232 at an angle of about 45 degrees, in general, any suitable angle that provides the desired functionality is acceptable.

As shown in FIG. 2, the first and second rim legs 234 and 236 and the intervening portion of the rim body 232 form a first cavity 240 for receiving the periphery 212 of the radome 210. Similarly, the second and third rim legs 236 and 238 and the intervening portion of the rim body 232 form a second cavity 242 for receiving the periphery 222 of the reflector 220.

The third rim leg 238 has a slanted or angled inner surface 244 facing the interior of the second cavity 242. The rim 230 is designed such that, as the rim is forced radially (down in FIG. 2) relative to the radome 210 and the reflector 220, the slanted inner surface 244 of the third rim leg 238 engages with the periphery 222 of the reflector to force the reflector 220 laterally towards the second rim leg 236 to physically abut with the second rim leg to form a metal-to-metal RF seal.

As shown in FIG. 2, the second rim leg 236 has an outer, recessed portion 246 and an inner, unrecessed portion 248, such that a clearance gap 249 exists between the recessed portion 246 and the corresponding outer edge region of the periphery 222 of the reflector 220, when the corresponding inner edge region of the periphery of the reflector abuts the unrecessed portion 248 of the second rim leg. This clearance gap 249 helps to ensure a good RF seal between the reflector 220 and the rim 230 when contaminants like paint and/or metal burrs exist on that outer edge region of the periphery of the reflector, which contaminants could otherwise prevent that good RF seal in the absence of such a clearance gap.

Figure 3C:
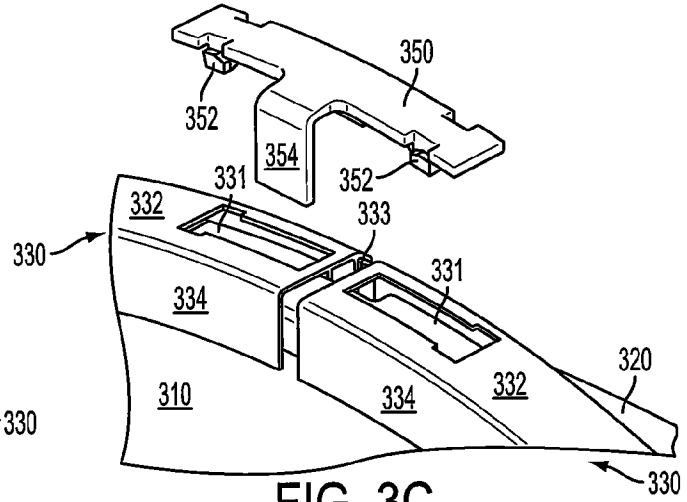
FIGS. 3(A)-(D) and 4(A)-(D) respectively show an exemplary set of fixed and adjustable clamps of the disclosure.
Figure 3D:
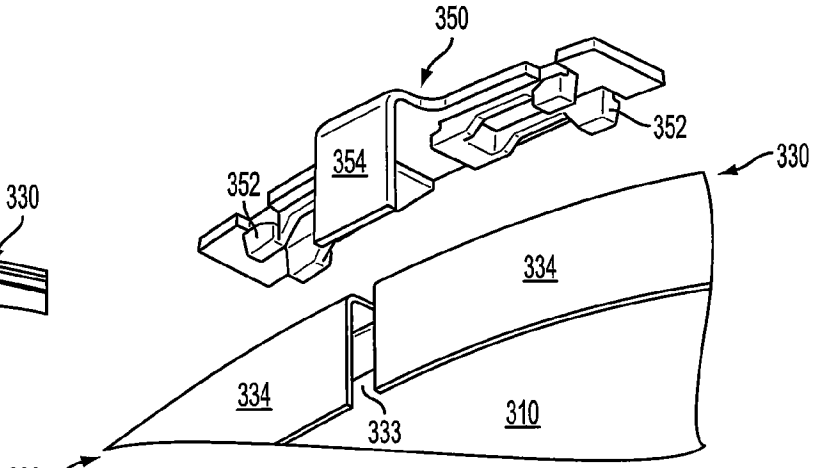
Figure 3A:
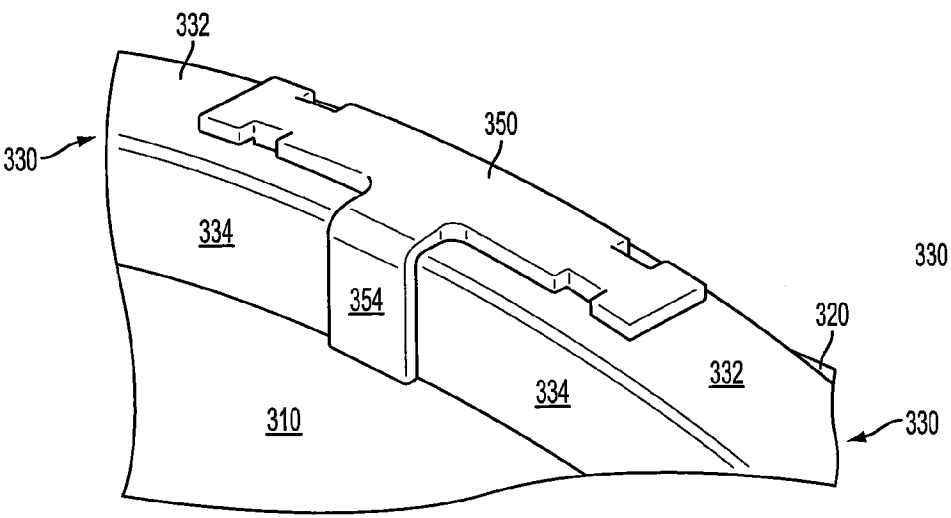
Figure 3B:
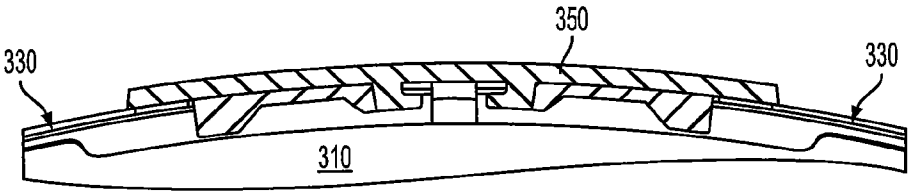

FIGS. 3(A) and 3(B) respectively show perspective and cut-away side views of an exemplary fixed clamp 350 used to secure two ends of two rims 330 retaining a radome 310 onto the periphery of a reflector 320. FIGS. 3(C) and 3(D) respectively show corresponding exploded, perspective views from above and from below.

As shown in FIGS. 3(A)-(D), fixed clamp 350 is a unitary structure made, e.g., of molded plastic. Fixed clamp 350 has keyed features 352 that fit within and slide forward to engage with two corresponding, mirror-image, keyed openings 331 in the circumferential bodies 332 of the two rims 330 to lock the fixed clamp in place, thereby securing the two ends of the two rims together. Fixed clamp 350 also has a cover portion 354 that limits exposure of the gap 333 between the two rims 330 to inhibit UV radiation and/or moisture from reaching the interior of the resulting radome-reflector assembly. Although not shown, fixed clamp 350 can include a moisture drain path for when it is fitted at the bottom of the radome-reflector assembly.

Figure 4C:
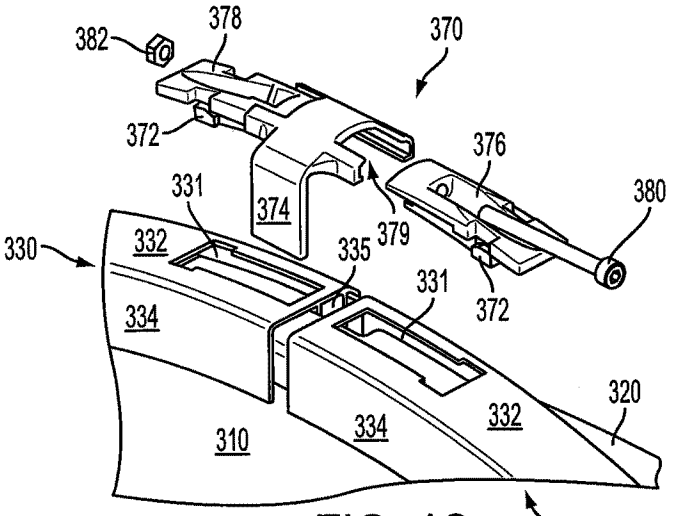
Figure 4D:
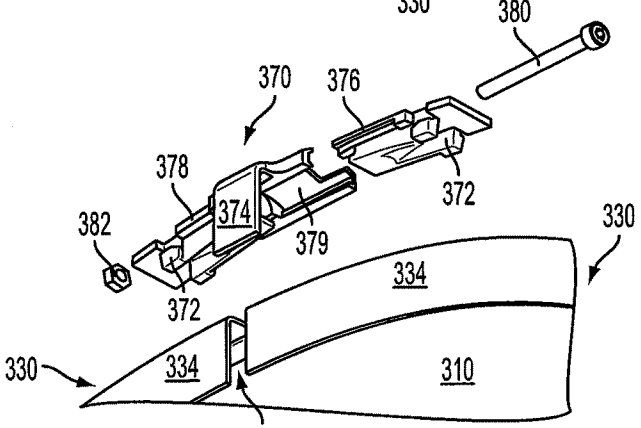
Figure 4A:
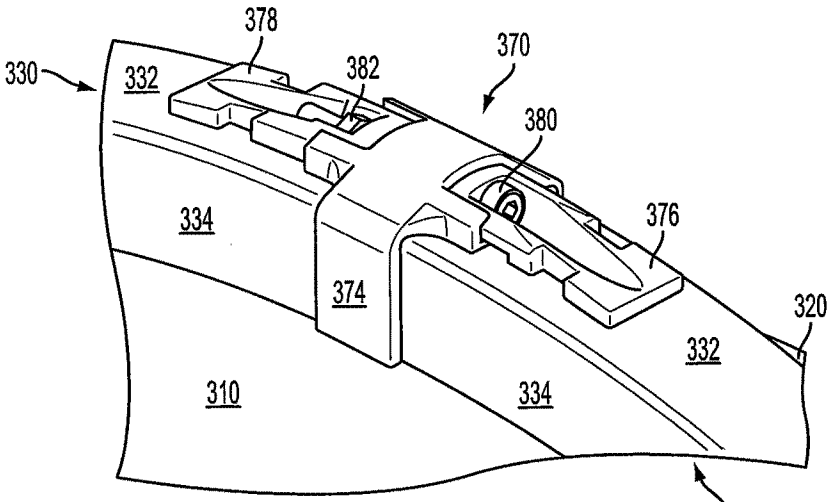
Figure 4B:
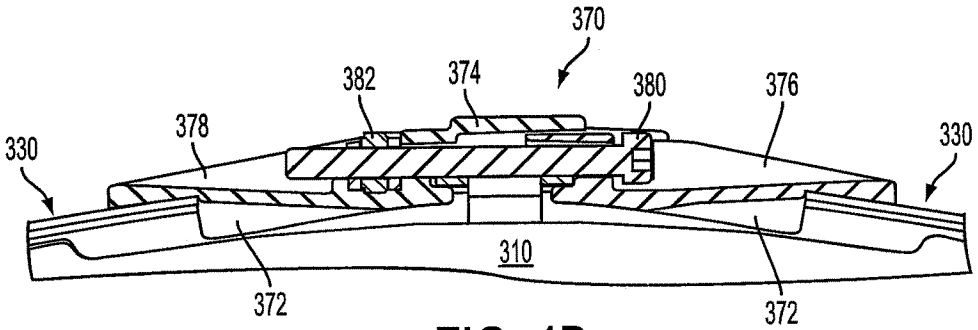

FIGS. 4(A) and 4(B) respectively show perspective and cut-away side views of an exemplary adjustable clamp 370 used to secure the other two ends of the two rims 330 of FIG. 3 retaining the radome 310 onto the periphery of the reflector 320. FIGS. 4(C) and 4(D) respectively show corresponding exploded, perspective views from above and from below. Adjustable clamp 370 has the following four elements:

A male component 376;

A female component 378 having a recess 379 that receives a corresponding portion of the male component;

A threaded screw 380 that fits within corresponding holes in the male and female components; and A threaded nut 382 that engages with the threaded end of the screw.

As shown in FIGS. 4(C) and 4(D) and similar to fixed clamp 350 of FIG. 3, the mirror-image, keyed openings 331 in the two rims 330 receive corresponding keyed features 372 on the bottoms of the male and female components 376 and 378. In addition, female component 378 has a cover portion 374 that limits exposure of the gap 335 between the two rims 330 to inhibit UV radiation and/or moisture from reaching the interior of the resulting radome-reflector assembly. In alternative embodiments, the male component 376 may have a cover portion in addition to or instead of the female component 378. Further embodiments may involve two (e.g., identical) components that do not have covers and do not engage as do male and female components. Although not shown, adjustable clamp 370 can include a moisture drain path for when it is fitted at the bottom of the radome-reflector assembly. Note that the nut 382 sits within a recess in the female component 378 that is shaped and sized to prevent the nut from rotating while the engaged screw 380 is rotated.

As explained previously, adjustable clamp 370 may be pre-assembled at a relatively loose setting (e.g., screw 380 within the corresponding holes in the male and female components 376 and 378, but with the nut 382 engaged near the threaded end of the screw 380). After fixed clamp 350 of FIG. 3 is inserted to secure its two ends of rims 330 together (with the peripheries of the radome 310 and the reflector 320 respectively in place within the two rims' first and second cavities (analogous to cavities 240 and 242 of FIG. 2)), the pre-assembled adjustable clamp 370 may be inserted into the corresponding openings 331 at the other two ends of the rims. The screw 380 can then be rotated to tighten the adjustable clamp 370, thereby reducing the size of gap 335 between the ends of the two rims 330. Note that, as explained above with respect to the slanted surface 244 of the third rim leg 238 of rim 230, as the adjustable clamp 370 is tightened, the periphery of the reflector 320 will be forced laterally against the second rim legs (not shown in FIG. 4) of the two rims 330 to form a good metal-to-metal RF seal between the metal rims and the metal reflector.

Note that the keyed openings 331 at either end of each rim 330 are mirror images, such that both rims 330 are identical to one another, simply rotated radially 180 degrees from one another. Furthermore, the corresponding keyed features 352 and 372 of the fixed and adjustable clamps 350 and 370 are identical such that either clamp can be used at either the top or the bottom of the radome-reflector assembly (as top and bottom are depicted in the view of FIG. 1). Moreover, in theory, two rims 330 could be secured to one another at both pairs of ends using two fixed clamps 350 or two adjustable clamps 370, instead of one of each.

In the embodiment of FIG. 4, the screw is inserted from the male component 376 into the female component 378, and the nut resides within the female component. In an alternative embodiment, the opposite is true. In still other embodiments, the screw hole in the second component is threaded to engage the screw or a self-tapping screw may be used with an unthreaded hole, such that the nut may be omitted. In further embodiments, a ratchet-based mechanism may be employed to move the male and female components together over inter-locking serrated edges, such that both the nut and the screw may be omitted.

Figure 5B:
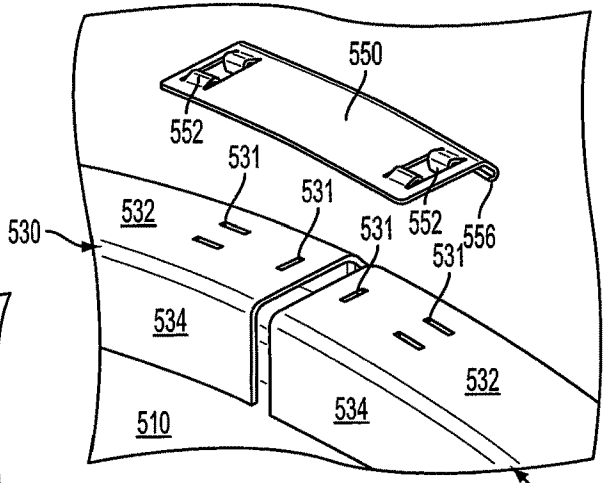
FIGS. 5(A)-(C) and 6(A)-(C) respectively show another exemplary set of fixed and adjustable clamps of the disclosure.
Figure 5C:
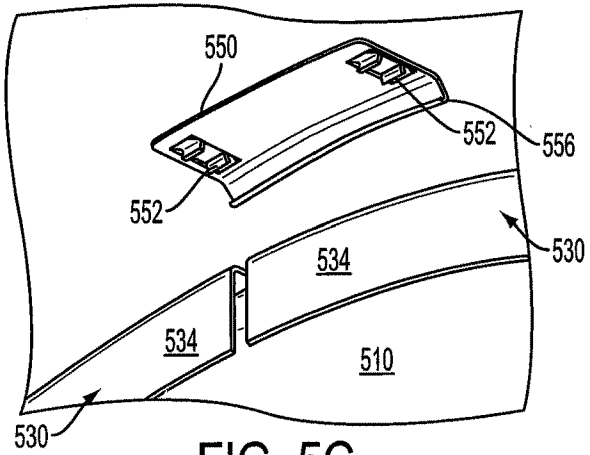
Figure 5A:
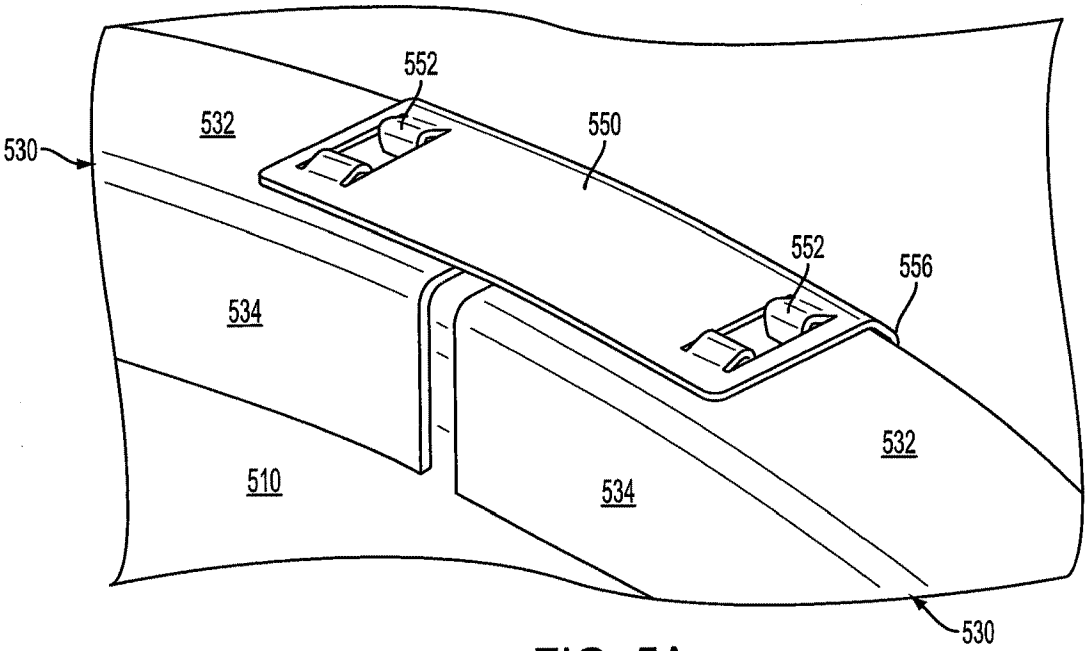
Figure 6A:
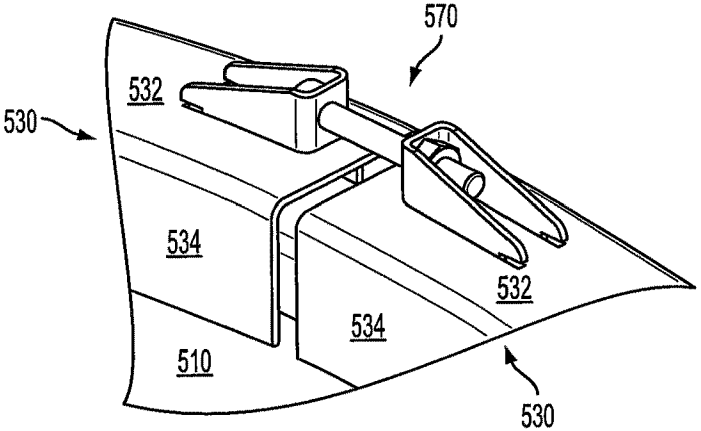
Figure 6B:
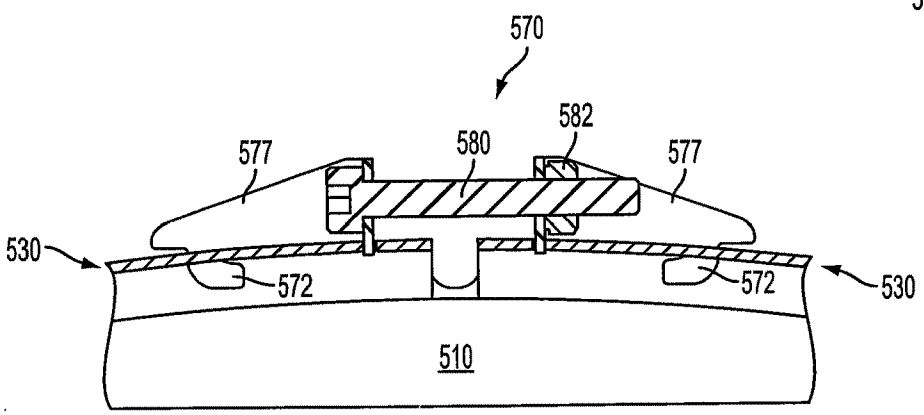
Figure 6C:
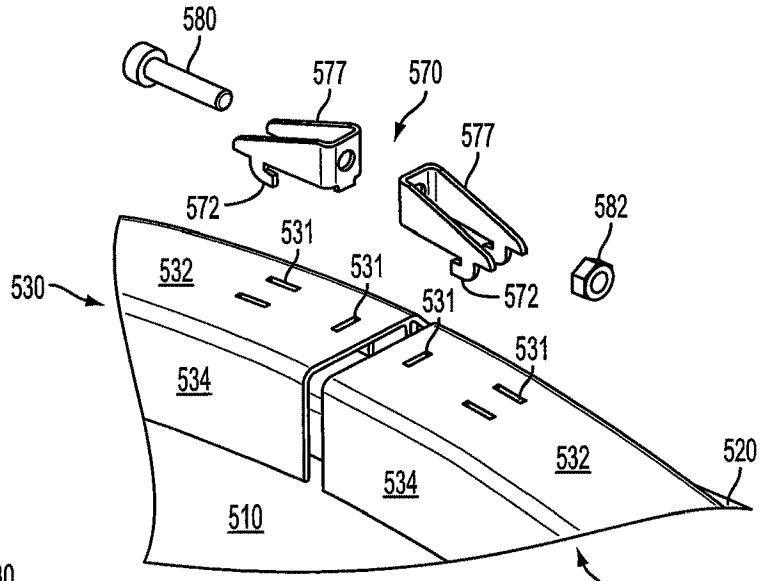

FIGS. 5 and 6 respectively show another exemplary set of fixed and adjustable clamps 550 and 570 that can be used to secure two rims 530 together to form another exemplary radome-reflector assembly of the disclosure. In particular, FIG. 5(A) shows a perspective view of the fixed clamp 550 (e.g., a pressed stainless steel bracket) used to secure two ends of the two rims 530 retaining a radome 510 onto the periphery of a reflector (not shown in FIG. 5, but labeled as 520 in FIG. 6(C)), while FIGS. 5(B) and 5(C) respectively show corresponding exploded, perspective views of the fixed clamp 550 from above and from below. FIGS. 6(A) and 6(B) respectively show perspective and cut-away side views of the adjustable clamp 570 used to secure the other two ends of the two rims 530 retaining the radome 510 onto the periphery of the reflector 520, while FIG. 6(C) shows a corresponding exploded, perspective view from above.

As shown in FIGS. 5(B) and 5(C), rims 530 have identical, mirror-image sets of openings 531 at their two ends which receive corresponding features 552 and 572 of either the fixed clamp 550 or the adjustable clamp 570. Note that openings 531 forceably receive features 552 of fixed clamp 550. Fixed clamp 550 also has a curved edge feature 556 that engages with features (not shown) of the two rims 530 (e.g., analogous to the third rim leg 238 of rim 230 of FIG. 2) to secure the fixed clamp 550 in place. Adjustable clamp 570 has two identical components 577 (e.g., pressed stainless steel brackets) that are secured together using a screw 580 and a nut 582. The fixed clamp 550 and (pre-assembled) adjustable clamp 570 can be used to assemble a radome-reflector assembly having a good metal-to-metal RF seal in a manner similar to the manner described earlier using fixed and adjustable clamps 350 and 370 of FIGS. 3 and 4.

Figure 7A:
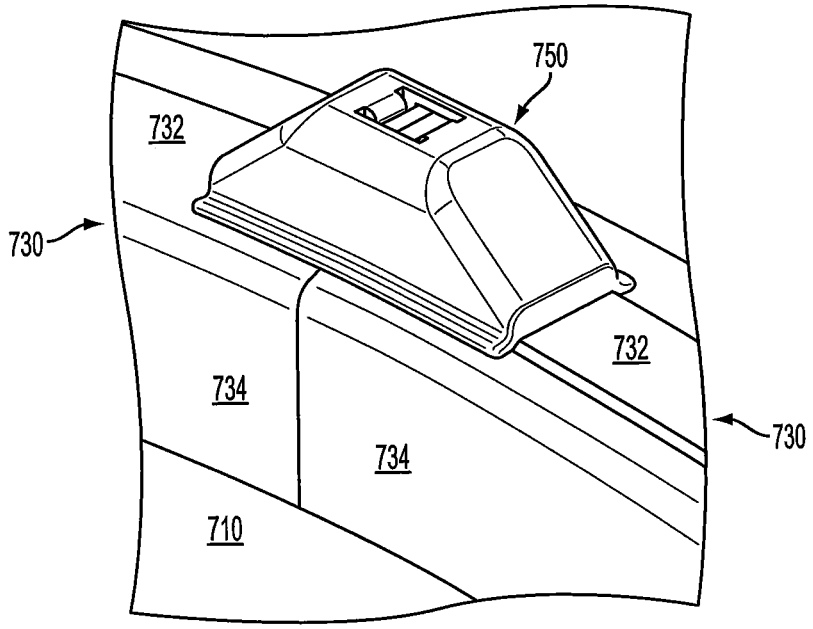
FIGS. 7(A)-(B) and 8(A)-(C) respectively show yet another exemplary set of fixed and adjustable clamps of the disclosure.
Figure 7B:
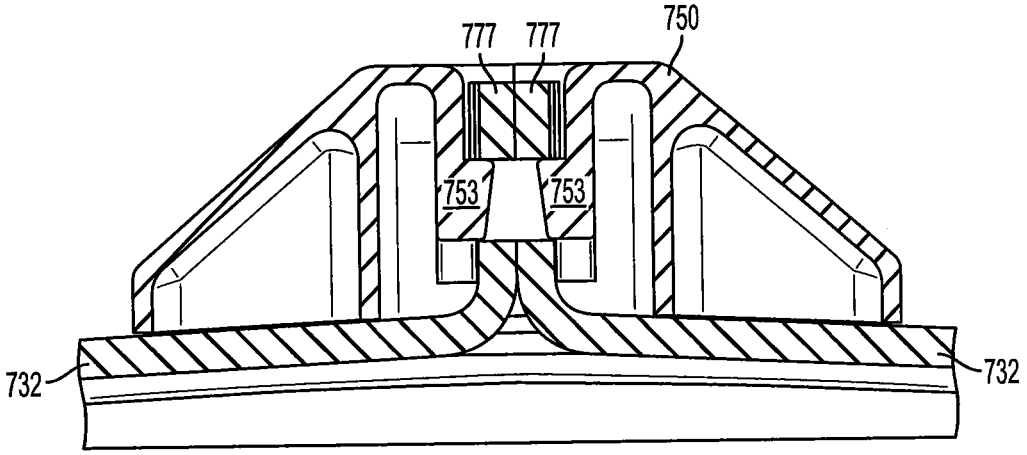
Figure 8A:
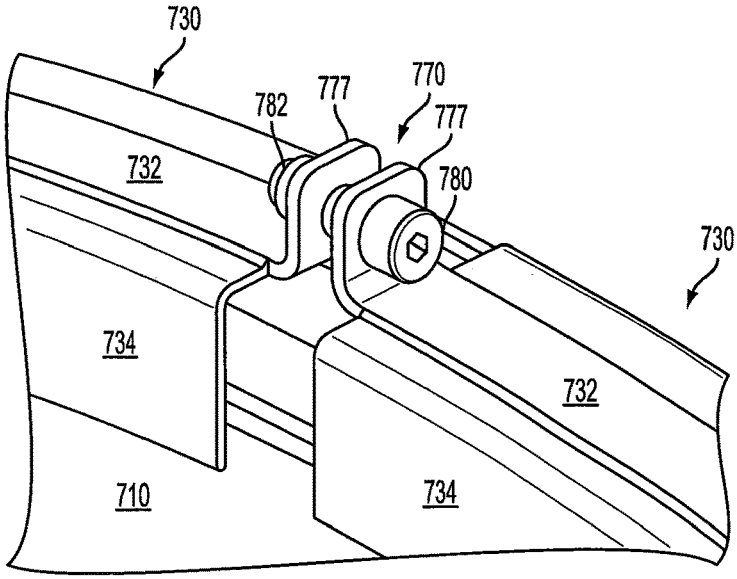
Figure 8B:
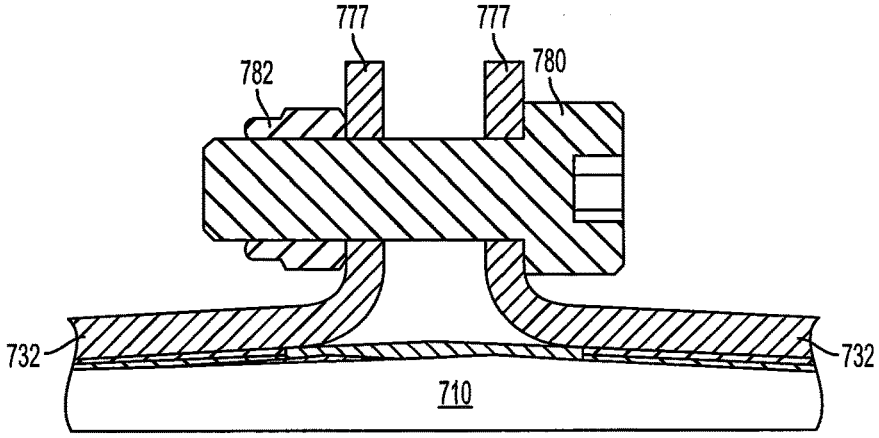

FIGS. 7 and 8 respectively show yet another exemplary set of fixed and adjustable clamps 750 and 770 that can be used to secure two rims 730 together to form another exemplary radome-reflector assembly of the disclosure. In particular, FIGS. 7(A) and 7(B) respectively show perspective and cut-away side views of the fixed clamp 750 used to secure two ends of the two rims 730 retaining a radome 710 onto the periphery of a reflector (not shown in FIGS. 7 and 8). FIGS. 8(A) and 8(B) respectively show perspective and cross-sectional side views of the adjustable clamp 770 used to secure the other two ends of the two rims 730 retaining the radome 710 onto the periphery of the reflector, while FIG. 6(C) shows a perspective view of one end of one rim 730.

Figure 8C:
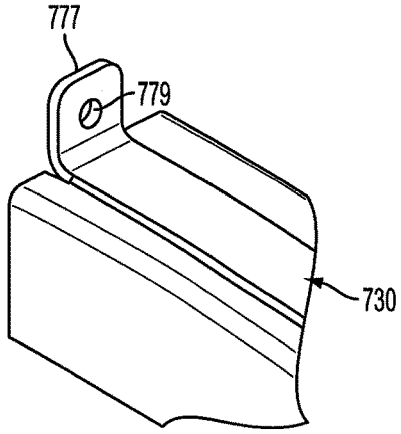

As shown in FIG. 8(C), each rim 730 has an integral, stamped bracket or flange 777 having an opening (i.e., hole) 779. As shown in FIG. 7(B), fixed clamp 750 has two opposing, resilient, barbed arms 753 that deflect when fixed clamp 750 is forced over a pair of mated flanges 777 of the two rims 730 and then un-deflect when the barbed ends of arms 753 reach the openings in the flanges 777 to lock the fixed clamp 750 in place, thereby securing the ends of the two rims together. As shown in FIGS. 8(A) and 8(B), the other two ends of the rims 730 are secured using adjustable clamp 770 which involves inserting a screw 780 into the openings in the corresponding flanges 777 and securing the screw in place using a nut 782. The screw-and-nut assembly can be adjusted to control the connecting force used to secure the rims together and form a good metal-to-metal RF seal between the reflector and the rims 730 as described previously.

Figure 9A:
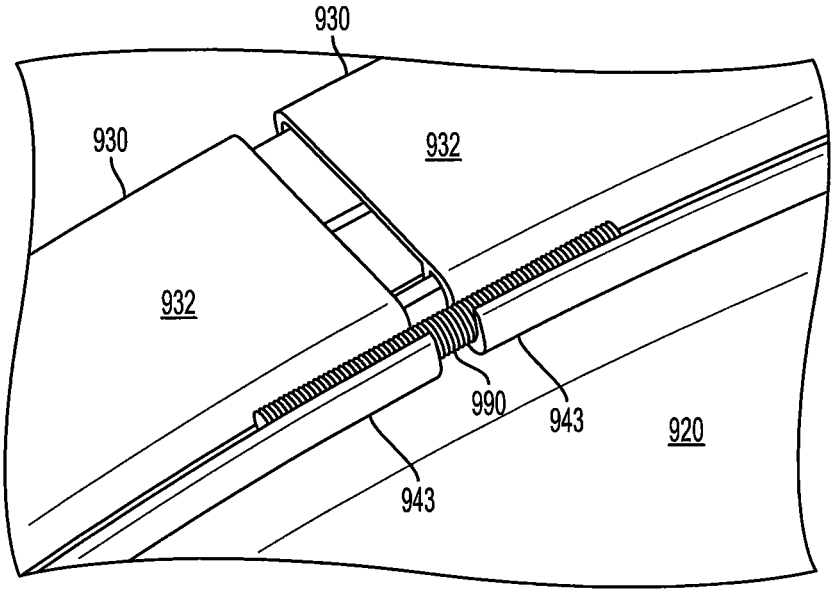
FIGS. 9(A)-(B) shows another exemplary radome-reflector assembly of the disclosure.
Figure 9B:
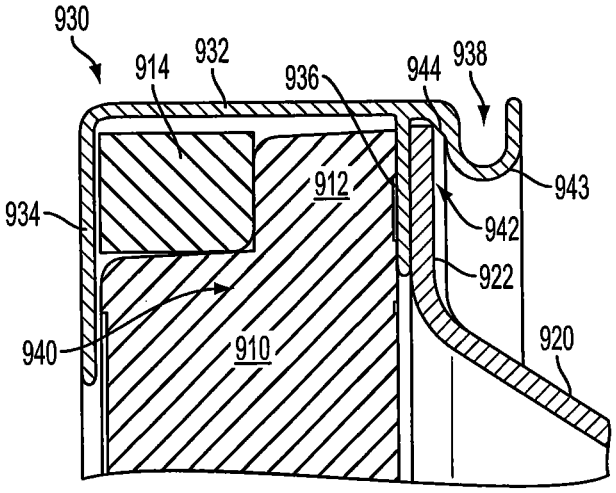

FIG. 9(A) shows a perspective, partial view of another exemplary pair of metal rims 930 for another exemplary radome-reflector assembly of the disclosure. FIG. 9(B) shows a cross-sectional side view of each of the rims 930.

As shown in FIG. 9(B), similar to rim 230 of FIG. 2, each rim 930 has the following four elements:

A semi-cylindrical, circumferential rim body 932, supporting the other elements of the rim;

A first, radial rim leg 934, extending perpendicularly from the rim body 932 towards the center line of the semi-cylinder defined by the rim body;

A second, radial rim leg 936, shorter than the first rim leg 934, but also extending perpendicularly from the rim body 932 towards the semi-cylinder center line; and A third rim leg 938, having a U-shaped "crimp" portion 943 and a slanted, inner surface 944.

As with the embodiment of FIG. 2, in alternative embodiments, the second rim leg need not be shorter than the first rim leg.

As shown in FIG. 9(B), the first and second rim legs 934 and 936 and the intervening portion of the rim body 932 form a first cavity 940 for receiving the periphery 912 of a radome 910 and an (optional) RF absorber gasket 914. Although not shown in FIG. 2, an analogous RF absorber gasket could be included within the first cavity 240 of rim 230 of radome-reflector assembly 200. Similarly, the second and third rim legs 936 and 938 and the intervening portion of the rim body 932 form a second cavity 942 for receiving the periphery 922 of a metal reflector 920.

As with rim 230 of FIG. 2, the rim 930 is designed such that, as the rim is forced radially (down in FIG. 9(B)) relative to the radome 910 and the reflector 920, the slanted, inner surface 944 of the third rim leg 938 engages with the periphery 922 of the reflector to force the reflector laterally towards the second rim leg 936 to physically abut the second rim leg to form a metal-to-metal RF seal. Although not shown in FIG. 9(B), the second rim leg 936 of rim 930 may have a recessed portion to form a clearance gap in order to accommodate contaminants on the outer edge region of the reflector 920 similar to that of rim 230 of FIG. 2.

As shown in FIG. 9(A), the U-shaped crimp portion 943 of the third rim leg 938 is designed to forceably receive and be crimped around a (e.g., threaded) press-fit, joining piece 990 to secure the two rims 930 together in a manner similar to that described in the '991 publication. Another identical joining piece 990 would also be used to secure the other two ends of the rims 930 together.

In addition to those discussed previously, the rim-based mechanisms of the present disclosure may provide one or more of the following additional advantages over the rim-based mechanism of the '991 publication in assembling radome-reflector assemblies. The amount of circumferential connecting force applied to certain rims of the present disclosure in order to form a good RF seal may be less than the corresponding connecting force applied per the '991 publication. As such, corresponding radome-reflector assemblies of the present disclosure can be assembled without the use of relatively large clamping fixtures. In fact, certain radome-reflector assemblies of the present disclosure can be assembled in the field without requiring the use of any clamping fixtures or other special tooling.

Moreover, the lighter circumferential connecting force reduces the risk of physically distorting the shape of the reflector, thereby avoiding antenna performance degradation that might otherwise result from such physical distortion. The lighter circumferential connecting force also enables the fixed and adjustable clamps to be made of molded or pressed plastic or low-cost metal.

Furthermore, certain radome-reflector assemblies of the present disclosure do not require frequency-specific back-lobe suppression rings, opening the opportunity to produce assemblies having broader frequency bands of operation.

In certain embodiments, such as those shown in FIGS. 3 and 4, the clamps and rims are designed such that the clamps sit relatively low within openings in the rims, where the circumferential connecting force applied by the clamps (e.g., the screw and nut) is substantially at the same radial distance from the center points of the radome and the reflector as the rim body elements. Such a configuration limits torquing forces that can otherwise bend the clamp components, further enabling them to be made of plastic or low-cost metal. The resulting low profiles of the clamping mechanisms also keeps the overall sizes of the resulting radome-reflector assemblies small, which reduces packing costs.

Although the present disclosure has been described in the context of metal rims and metal reflectors, in other embodiments, other suitable materials may be used for the rims and/or reflectors.

Although the present disclosure has been described in the context of radome-reflector assemblies having exactly two rims, in alternative embodiments, assemblies may have more than two rims or just a single rim. For embodiments having three or more rims, each pair of adjacent rims could be interconnected using either a fixed clamp or an adjustable clamp. In some of those embodiments, at least one pair of adjacent clamps are interconnected using an adjustable clamp. For embodiments having just a single rim, the substantially circular rim would have a gap such that the two ends of the rim would be bridged by a clamp that would be applied/tightened after the rim was twisted around the periphery of the radome and the sub-assembly then applied to the periphery of the reflector. In some of those embodiments, the clamp is an adjustable clamp. It is also possible to have a hinged rim assembly consisting of two or more rims interconnected by one or more hinges, where the hinged rim assembly would have one or more gaps that would be bridged by one or more corresponding, fixed or adjustable clamps.

One common feature of the embodiments of the present disclosure described above is the existence of a slanted inner surface on the third rim leg that forces the reflector laterally against the second rim leg to form a good RF seal when circumferential connecting force is applied by an adjustable clamp securing two ends of the rims together. Another common feature is that the peripheries of the radome and the reflector are received within different rim cavities.

Unless explicitly stated otherwise, each numerical value and range should be interpreted as being approximate as if the word "about" or "approximately" preceded the value or range.

It will be further understood that various changes in the details, materials, and arrangements of the parts which have been described and illustrated in order to explain embodiments of this invention may be made by those skilled in the art without departing from embodiments of the invention encompassed by the following claims.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

The invention claimed is:

1. An apparatus for securing a radome to a reflector, the apparatus comprising:

one or more rims, each rim receiving a periphery of the radome and a periphery of the reflector; and an adjustable clamp configured to connect a pair of adjacent rim ends together, wherein the adjustable clamp can be adjusted to control an amount of connecting force applied between the pair of adjacent rim ends, wherein the adjustable clamp comprises:

a first component rigidly connectable to a first end of the pair of adjacent rim ends;

a second component rigidly connectable to a second end of the pair of adjacent rim ends; and an actuator component configured to be adjustably connected between the first and second components to apply the connecting force, wherein the actuator component applies the connecting force to the pair of adjacent rim ends at a same radial distance from center points of the radome and the reflector as bodies of the one or more rims.

2. The apparatus of claim 1, wherein the one or more rims comprise first and second rims, and wherein the apparatus further comprises one or more clamps, wherein the one or more clamps comprise:

a first clamp configured to connect first ends of the first and second rims together; and the adjustable clamp configured to connect second ends of the first and second rims together, wherein the adjustable clamp can be adjusted to control an amount of connecting force applied between the second ends of the first and second rims.

3. The apparatus of claim 2, wherein the first clamp is a fixed clamp configured to rigidly connect the first ends of the first and second rims together.

4. The apparatus of claim 1, wherein:

the actuator component comprises a screw; and the first and second components each have a hole for receiving the screw.

5. The apparatus of claim 1, wherein:

the actuator component comprises a screw and a nut; and the first and second components are flanges integral to the pair of adjacent rim ends and each having a hole for receiving the screw such that the nut and a head of the screw are supported by structure surrounding the holes in the first and second components.

6. The apparatus of claim 1, wherein:

the first component is a male component; and the second component is a female component configured to receive a portion of the male component.

7. The apparatus of claim 6, wherein the male and female components are configurable to form a pre-assembled clamp with the female component receiving the portion of the male component and the male component secured to the female component by the actuator component such that (i) the pre-assembled clamp can be inserted into the openings in the pair of adjacent rim ends and (ii) the actuator mechanism can be adjusted to control the connecting force between the pair of adjacent rim ends.

8. The apparatus of claim 6, wherein at least one of the male and female components comprises a cover that covers a gap between the pair of adjacent rim ends.

9. A radome-reflector assembly comprising the radome secured to the reflector using the apparatus of claim 1.

10. An apparatus for securing a radome to a reflector, the apparatus comprising:

one or more rims, each rim receiving a periphery of the radome and a periphery of the reflector; and an adjustable clamp configured to connect a pair of adjacent rim ends together, wherein the adjustable clamp can be adjusted to control an amount of connecting force applied between the pair of adjacent rim ends, and wherein the adjustable clamp comprises:

a first component rigidly connectable to a first end of the pair of adjacent rim ends;

a second component rigidly connectable to a second end of the pair of adjacent rim ends; and an actuator component configured to be adjustably connected between the first and second components to apply the connecting force, wherein the first and second components are configured to be secured within one or more keyed openings in the pair of adjacent rim ends, respectively.

11. The apparatus of claim 10, wherein:

the first component is a male component; and the second fixed component is a female component configured to receive a portion of the male component.

12. The apparatus of claim 11, wherein the male and female components are configurable to form a pre-assembled clamp with the female component receiving the portion of the male component and the male component secured to the female component by the actuator component such that (i) the pre-assembled clamp can be inserted into the openings in the pair of adjacent rim ends and (ii) the actuator mechanism can be adjusted to control the connecting force between the pair of adjacent rim ends.

13. The apparatus of claim 11, wherein at least one of the male and female components comprises a cover that covers a gap between the pair of adjacent rim ends.

14. The apparatus of claim 10, wherein the actuator component applies the connecting force to the pair of adjacent rim ends at a same radial distance from center points of the radome and the reflector as bodies of the one or more rims.

15. An apparatus for securing a radome to a reflector, the apparatus comprising:

one or more rims, each rim receiving a periphery of the radome and a periphery of the reflector; and an adjustable clamp configured to connect a pair of adjacent rim ends together, wherein the adjustable clamp can be adjusted to control an amount of connecting force applied between the pair of adjacent rim ends, wherein the adjustable clamp comprises:

a first component rigidly connectable to a first end of the pair of adjacent rim ends, wherein the first component is a male component;

a second component rigidly connectable to a second end of the pair of adjacent rim ends, wherein the second component is a female component configured to receive a portion of the male component; and an actuator component configured to be adjustably connected between the first and second components to apply the connecting force.

16. The apparatus of claim 15, wherein the male and female components are configurable to form a pre-assembled clamp with the female component receiving the portion of the male component and the male component secured to the female component by the actuator component such that (i) the pre-assembled clamp can be inserted into the openings in the pair of adjacent rim ends and (ii) the actuator mechanism can be adjusted to control the connecting force between the pair of adjacent rim ends.

17. The apparatus of claim 15, wherein at least one of the male and female components comprises a cover that covers a gap between the pair of adjacent rim ends.

* * * * *